United States Patent [19]

Rajala

[11] Patent Number: 4,894,147

[45] Date of Patent: Jan. 16, 1990

[54] DEVICE FOR SCREENING PULP AND A BLADE FOR THE SCREENING DEVICE

[75] Inventor: Veli-Matti Rajala, Tampere, Finland

[73] Assignee: OY Tampella AB, Tampere, Finland

[21] Appl. No.: 314,375

[22] Filed: Feb. 22, 1989

[30] Foreign Application Priority Data

Mar. 7, 1988 [FI] Finland ..... 881049

[51] Int. Cl.[4] ..... B07B 1/20

[52] U.S. Cl. ..... 209/273; 209/255; 209/270; 210/413

[58] Field of Search ..... 209/268, 270, 273, 306, 209/380, 261, 254, 255; 162/55; 210/413, 415

[56] References Cited

U.S. PATENT DOCUMENTS

| | | | |
|---|---|---|---|
| 2,835,173 | 5/1958 | Martindale | 209/270 |
| 3,029,951 | 4/1962 | Cannon | 209/273 X |
| 4,003,837 | 1/1977 | Osborne | 210/413 X |
| 4,193,865 | 3/1980 | Aario | 209/273 X |
| 4,383,918 | 5/1983 | Chupka et al. | 209/273 X |

FOREIGN PATENT DOCUMENTS

| | | | |
|---|---|---|---|
| 1283053 | 7/1972 | United Kingdom | 209/273 X |

*Primary Examiner*—Donald T. Hajec
*Attorney, Agent, or Firm*—Ladas & Parry

[57] ABSTRACT

The invention relates to a device for screening pulp, comprising a screen drum (2) provided with holes for the passage of an accepted pulp fraction therethrough; and a blade (10) for a screening device. The device comprises straight blades (10) wiping the surface of the screen drum (2) and extending in parallel with the axis of the screen drum (2). Reject which does not pass through the screen drum (2) is removed through a reject discharge opening (5) at the other end of the screen drum. For transferring the reject from the surface of the screen drum (2) to the reject discharge end, the surface of the blades (10) is on the screen drum side provided with grooves (11) so inclined that the front end of the groove (11) is closer to the pulp input than the rearmost end of the same groove (11). Thereby each groove (11) in the blades (10) causes the reject to be transferred towards the reject discharge opening (5).

13 Claims, 2 Drawing Sheets

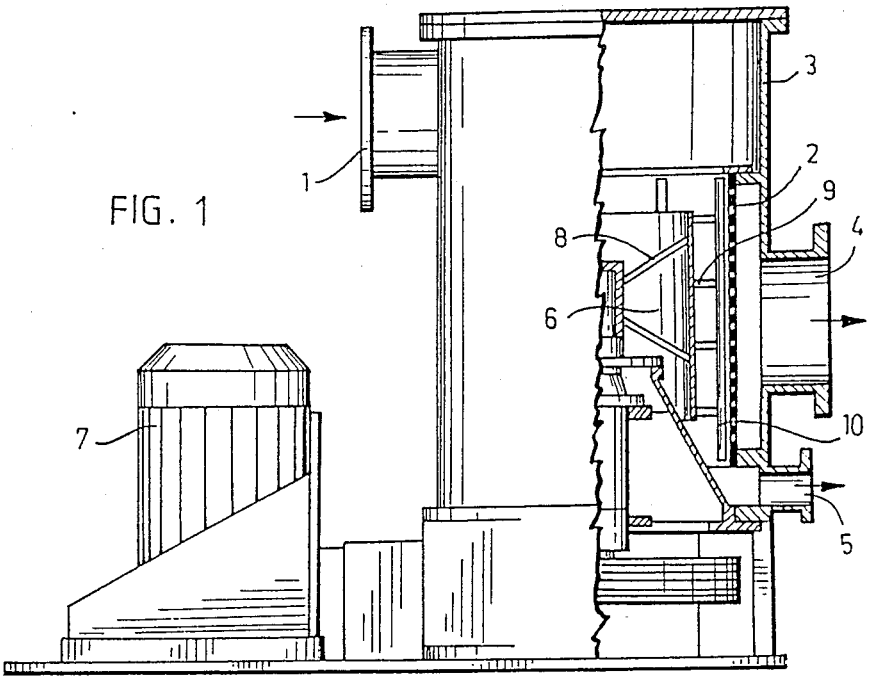
FIG. 1
FIG. 2
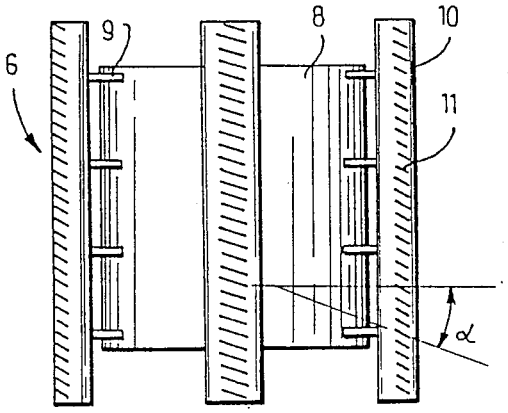
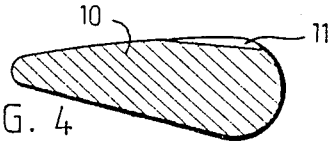
FIG. 4
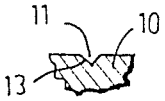
FIG. 5
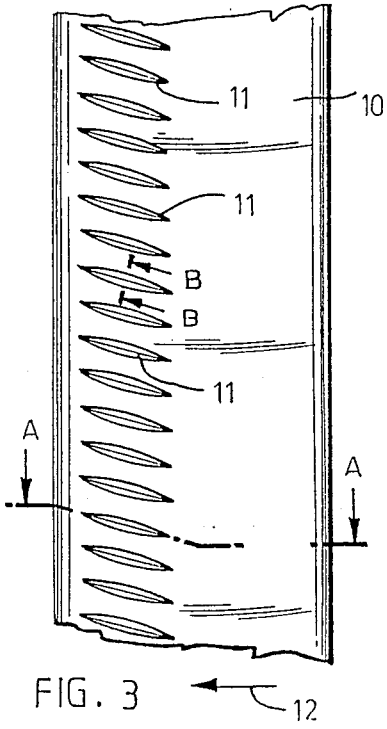
FIG. 3

FIG. 6
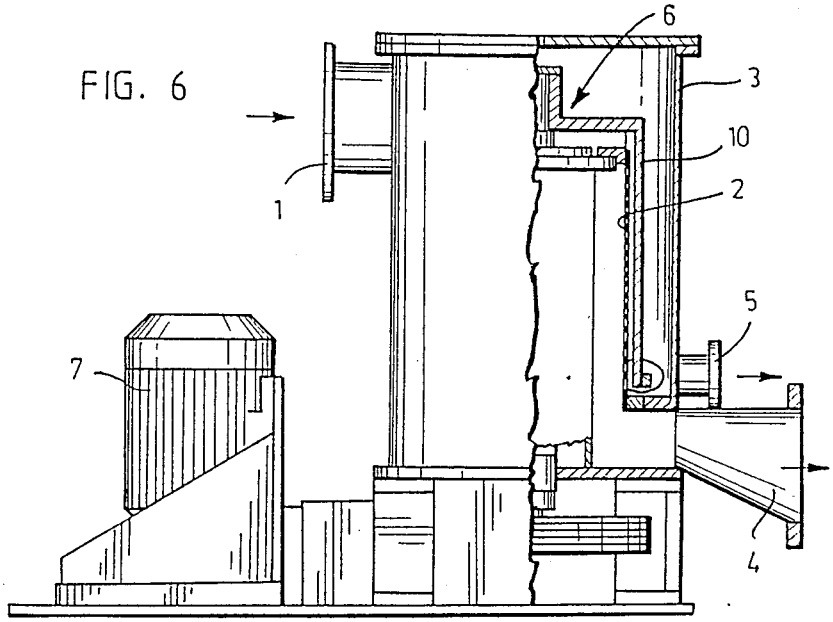
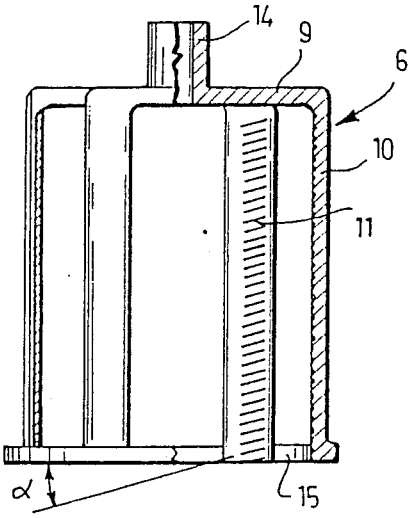
FIG. 7
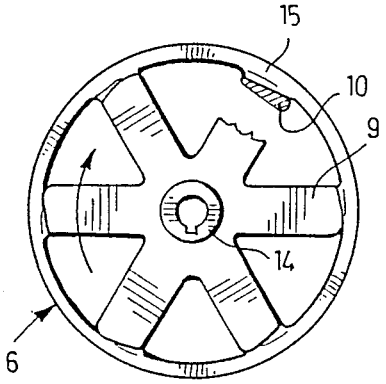
FIG. 8

DEVICE FOR SCREENING PULP AND A BLADE FOR THE SCREENING DEVICE

The invention relates to a device for screening pulp, comprising a screen drum provided with openings and allowing the passage of a desired pulp fraction therethrough, and substantially vertical blades mounted close to the surface of the screen drum, the screen drum and/or the blades being mounted rotatably around the axis of the screen drum so that the blades and the surface of the screen drum move with respect to each other through a rotatory motion, and the pulp being introduced into the screening device to one end of the screen drum and a rejected pulp fraction being discharged from the other end thereof.

The invention is further concerned with a blade for a pulp screening device comprising a screen drum provided with openings and allowing the passage of a desired pulp fraction therethrough, and substantially vertical or upwardly extending blades positioned close to the surface of the screen drum, the screen drum and/or the blades being mounted rotatably around the axis of the screen drum so that the blades and the surface of the screen drum move with respect to each other through a rotatory motion, and the pulp being introduced into the screening device to one end of the screen drum and a rejected pulp fraction being discharged through the other end thereof.

For screening, pulp is introduced into a screen comprising a screen drum provided with openings, such as holes or slits, and blades rotating within the screen drum around its axis and close to its inner surface or alternatively outside the screen drum close to the outer surface of the screen drum. The function of the blades is to keep the inner or respectively the outer surface of the screen drum clean and to transfer the fibre material which does not pass through the screen drum to the other end of the screen drum, and further out of the screen as a reject. Correspondingly, screens are used in which the screen drum rotates while the blades are stationary. The fibre material going through the openings of the screen drum is passed to further processing. When internal blades are used, the pulp is usually introduced inside the screen drum, so that the reject passes through the screen drum in the axial direction thereof before it is discharged. When using external blades, the pulp is usually introduced outside the screen drum between it and the shell of the screen, so that the reject passes in the axial direction of the screen drum through a ring-shaped passage defined between the screen drum and the shell before it is discharged. In both cases, the accepted fibre material flows through the openings in the screen drum from the inside to the outside or vice versa.

Each blade is shaped so that one surface thereof, generally the one facing the screen drum, is arched in some way. The blades are positioned so that when the blades and the screen drum move relative to each other, the blade surface closer to the screen drum is positioned near to the forward edge of the blade in the direction of movement, and the distance between the surface of the blade and the screen drum increases towards the rearmost edge of the blade, whereby an underpressure pulse is produced which detaches reject fibres adhering to the inner surface of the screen drum. Since reject fibres tend to return through the screen drum with the pulp flowing therethrough after the blades have passed, several different ways have been used in an attempt to transfer the fibres downwards in the axial direction of the screen drum.

Finnish Pat. No. 55535 discloses a screening device in which rotating blades are mounted at an angle in the direction of movement thereof so that the upper portion of the blade is ahead of the lower portion in the direction of movement. Being inclined, the forward edge of the blade tends to transfer the reject downwards similarly as a screw. This solution is expensive to manufacture, and the shape of the blades is inconvenient because the cross-section thereof has to be such as to be operative in view of the pulsation and, on the other hand, they have to be arched in order to follow the surface of the screen drum as accurately as possible at a desired distance when in an inclined position.

British Pat. No. 1,283,053, in turn, discloses a solution in which a number of helically disposed flat blades are provided within the screen drum, whereby the blades push reject fibres downwards when wiping the surface of the screen drum. The construction of this patent is difficult to manufacture because the blades have to be bent into helical form. Further, the pulsation ability of blades of this kind is nonexistent, wherefore reject fibres cannot be easily detached from the openings into which they have been wedged by the pressure of the flow of the pulp.

Still another well-known solution is to attach a steel band spirally to the inner surface of the screen drum, so that the band forms a helical spiral along the surface of the screen drum. A disadvantage of this construction, however, is the increased gap between the blades and the screen drum, which has deteriorated the operation of the screen.

The object of the invention is to provide a screening device which avoids the above-mentioned drawbacks; which effectively transfers the reject towards the reject discharge; and which is simple and inexpensive to manufacture. The screening device according to the invention is characterized in that in order to transfer the reject in the axial direction of the screen drum in the reject discharge direction, at least some of the blades are provided with grooves transverse to the longitudinal direction of the blades, said grooves being so inclined with respect to the direction of the movement between the blades and the surface of the screen drum that the foremost end of the groove in the direction of movement is in the axial direction of the screen drum at a greater distance from the reject discharge direction than the rearmost end of the same groove in the direction of movement.

The basic idea of the invention is to provide grooves on the blades of the screening device on the side facing the screen drum, the grooves being transverse to the longitudinal direction of the blade and so inclined relative to the direction of movement of the blade that the foremost end of the groove is closer to the direction of entry of the pulp and the rearmost end closer to the reject discharge, whereby the grooves act as winglike conveyor means and effect the flow of the reject in a desired direction.

An advantage of the invention is that at best it is possible to use a straight blade profile which is easy to manufacture and provide with reject transfer grooves of a desired kind with simple manufacturing techniques. Thereby the manufacture of the blades and the screening device as a whole is less expensive than the manufacture of devices with inclined blades, for instance. By means of the device according to the invention, the reject transfer ability of blades of various kinds and shapes is improved and the formed fibre bundles are broken by the fluidization effect caused by the microturbulence created by the grooves. Furthermore, the reject transfer ability can be greatly affected by the shape of the grooves, thus optimizing the overall operation of the device.

A further object of the invention is to provide a blade for a screening device of the above kind, which blade is simple and inexpensive to manufacture, which is able to transfer the reject towards the reject discharge opening sufficiently efficiently, and which avoid the above-mentioned drawbacks. The blade according to the invention is characterized in that in order to transfer the reject in the axial direction of the screen drum in the reject discharge direction, the blade is provided with grooves transverse to the longitudinal direction of the blade, said grooves being so inclined in the direction of the movement of the blades with respect to the surface of the screen drum that the foremost end of the groove in the direction of movement is in the axial direction of the screen drum at a greater distance from the reject discharge direction than the rearmost end of the same groove in the direction of movement.

It is essential in the invention that the surface of the blade profile on the side intended to face the screen drum is provided with inclined grooves transverse to the longitudinal direction of the blade, the direction of the grooves being such that when the blade has been mounted in place, the foremost groove end in the direction of movement of the blade is in the axial direction of the screen drum at a greater distance from the reject opening than the groove end adjacent to the rearmost edge of the blade, whereby the inclined surface of the groove acts as a helical transfer means during the movement of the blade, so that the reject fibres flow effectively towards the reject discharge opening at the bottom of the screen.

An advantage of the solution according to the invention is that the blade profile can be a straight profile rod which is easy to manufacture and simple to fasten to the rotation means and rotation arms and the distance of the surface of which from the surface of the screen drum is substantially constant when the blade is positioned in parallel with the axis of the screen drum. The reject transfer grooves can be formed on to the surface of the blade in a simple manner, and the inclination and depth as well as the number of the grooves are easy to determine according to the pulp to be screened.

The invention will be described in more detail in the attached drawings, wherein FIG. 1 is a general partial sectional view of a screening device according to the invention;

FIG. 2 shows a rotor in the screening device according to the invention;

FIG. 3 shows one embodiment of a blade according to the invention;

FIG. 4 is a cross-sectional view of the blade according to FIG. 3 at a point indicated with the references A—A;

FIG. 5 shows the shape of a preferred crosssection of a groove formed in the blade at a point indicated by the references B—B;

FIG. 6 is a partial sectional view of another screening device according to the invention;

FIG. 7 is a side view of the rotor of the screening device of FIG. 6 in a partial sectional view; and FIG. 8 is a top view of the rotor of FIG. 7 in a partial sectional view.

FIG. 1 shows a partial sectional view of a screening device for pulp into which the pulp to be screened is introduced tangentially through an inlet opening 1 positioned at the top of the screening device. At the top of the screening device, the pulp to be screened flows downwards through a vertical screen drum 2, whereby accepted fibre suspension, so called accept, is separated from the pulp through the openings of the screen drum 2 into a ring-shaped space defined between the screen drum 2 and the shell 3 of the screening device, wherefrom it is removed through a discharge opening 4 into further processing. Fibre material which has not passed through the openings of the screen drum 2, i.e., reject, settles on the bottom of the screening device, wherefrom it is removed through a reject discharge opening 5.

A rotor 6 is mounted centrally within the screen drum 2 coaxially therewith. The rotor is rotated by means of a motor 7 connected thereto. A cylindrical filler drum 8 is positioned in the middle of the rotor 6. The function of the filler drum 8 is to cause the fibre suspension to flow close to the surface of the screen drum 2 so as to be screened by means of it. The rotor 6 further comprises blades 10 attached thereto by means of arms 9 and extending substantially from one end of the screen drum 2 to the other. The blades are arranged at a small clearance from the inner surface of the screen drum 2 so as to wipe it when the rotor 6 rotates and to detach the pulp adhering to the screen drum 2 by means of hydraulic pulses. As shown in FIG. 1, the blades 10 are parallel with the axis of the screen drum 2, whereby they are easy to manufacture of a straight profile preform. However, the blades 10 can be made substantially vertical in some other way, too, whereby they may be slightly inclined with respect to the axis of the screen drum 2, provided that they are sufficiently accurately at the desired distance from the surface of the screen drum 2.

According to the invention the blades 10 are provided with grooves 11 within an area closest to the inner surface of the screen drum 2. These grooves are transverse to the longitudinal direction of the blade, and so inclined relative to the direction of movement of the blade that the foremost end of each groove 11 in the direction of movement of the blade 10 is in the axial direction of the screen drum 2 closer to the inlet opening 1 for the pulp and the other end is closer to the reject discharge opening 5, whereby the edge of the groove 11 tends to transfer the reject gathered on to the inner surface of the screen drum 2 downwards from the top portion of the screening device into the reject discharge opening 5 during the rotation of the rotor 6. As used in the present patent application and claims, the expression "direction of movement of the blade" refers to the direction in which the blade moves relative to the surface of the screen drum or both of them that are rotating. Correspondingly, the forward edge of the blade refers to that edge of the blade which is the foremost edge in the direction of movement of the blade at a certain height level.

FIG. 2 shows the rotor 6 of the screening device of FIG. 1. The rotor comprises six blades 10 positioned symmetrically relative to the central axis thereof. Each blade 10 is provided with grooves 11 positioned at an angle $\alpha$ with respect to the direction of movement of the blade 10, whereby an effect transferring the reject towards the reject discharge opening 5 is created at each blade 10.

FIG. 3 shows a portion of one preferred embodiment of the blade 10 as seen from the blade surface facing the inner surface of the screen drum 2. The direction of movement of the blade 10 is indicated with the arrow 12 and the shape of the cross-section of the blade in a corresponding direction is illustrated in FIG. 4. As appears from FIGS. 3 and 4, the blade is provided at the thickest point thereof with grooves 11 transverse to the longitudinal direction of the blade and inclined in the direction of movement thereof. The grooves 11 are positioned substantially over the whole area of the blade and, in the present embodiment, they are substantially uniformly spaced from each other. Preferably the grooves 11 are formed by cutting or grinding by means of a sharp-pointed disc or edge into a stationarily fixed blade preform, so that the obtained groove is such as shown in FIG. 3 from the top and has a cross-section such as shown in FIG. 5. In this preferred embodiment, the angle $\alpha$ is rather wide, about 15° C., so that the rate of movement of the fibres to be transferred into the pulp and into the reject will be suitable at conventional rates of rotation of the rotor. As appears from FIGS. 3 and 4, the grooves 11 are relatively small as compared with the thickness of the rotor and in order to obtained the desired effect, it is often sufficient that the length of the grooves 11 is less than one half of the width of the blade 10. The shape of the upper surface 13 of the grooves 11, against which the pulp tends to be pressed, is such that when the rotor rotates, the pulp flows downwards over a distance. Since the grooves 11 in the surfaces of all the blades 10 create a similar effect, all of the reject on the inner surface of the screen drum 2 is gradually transferred downwards while the accept is able to flow through the openings in the screen drum 2 into the discharge conduit 4.

FIGS. 6 to 8, wherein the same reference numerals as in FIGS. 1 to 5 are used for corresponding parts, show a screening device provided with blades 10 positioned outside the screen drum 2 and a rotor 6 intended therefor. The pulp to be screened is introduced through an opening 1 above the screen drum 2 and is passed therefrom into a ring-shaped space defined between the shell 3 and the screen drum 2. Blades 10 mounted in the rotor 6 rotate along the outer surface of the screen drum 2 in said ring-shaped space, detaching the material adhering thereto so as to prevent the clogging of the openings of the screen drum 2. In order to transfer the reject, grooves 11 are provided on the inner surface of each blade 10, i.e., on the surface facing the screen drum 2 in a corresponding way as in the solution shown in FIGS. 1 to 5.

FIG. 7 shows the rotor 6 of the screening device. The blades 10 are attached at the upper end thereof by means of arms 9 to a shaft head 14 of the rotor 6 and at the lower end thereof to a ring-shaped part 15 which surrounds the screen drum 2 when the rotor 6 is fixed stationarily. In this construction, too, the preferred way of manufacture of the blades 10 is to make them of a straight profile preform and to mount them in the axial direction of the screen drum 2. However, it is also possible to mount the blades in a slightly inclined position though the blades nevertheless are substantially vertical. Essential is that the grooves 11 have the right direction and dimensions.

In the attached figures, only one specific embodiment of the invention has been described. The invention, however, is not restricted to this embodiment. According to the invention, grooves can be formed in vertical blades as well as in substantially vertical blades slightly inclined in some direction. The length, width and shape of the grooves 11 may vary as desired depending on the operating conditions and other structural and operational factors of the screen. The grooves may be rectangular, arched, sawtooth-shaped, etc., in cross-section. Depending on the rate of rotation of the rotor or the screen drum and the number of blades, the groove may be shorter than in the example or it may extend substantially over the whole width of the blade either with uniform shape or varying in cross-section. The cross-section of the blade may be such as shown in the figure or differ therefrom. The inclination of the grooves in the direction of movement of the blade may also be such as required in each particular case, if only the groove is transversely positioned with respect to the longitudinal direction of the blade and in an inclined position in the direction of movement of the blade.

I claim:

1. A device for screening pulp for removing a rejected pulp fraction from a desired pulp fraction, comprising a screen drum (2) having a surface provided with openings and allowing the passage of the desired pulp fraction therethrough, and a plurality of substantially upwardly extending blades (10) mounted close to the surface of the screen drum (2), one of the screen drum (2) and the blades (10) being mounted rotatably for movement in a predetermined direction around the axis of the screen drum (2) so that the blades (10) and the surface of the screen drum (2) move with respect to each other through a rotatory motion, and the pulp being introduced into the screening device to one end of the screen drum (2) and said rejected pulp fraction traveling along the axis of the screen drum in a discharge direction to be discharged from the other end thereof, characterized in that in order to transfer the rejected pulp in the discharge direction, at least some of the blades (10) are provided with grooves (11) transverse to the upward extend of the blades (10), said grooves being so inclined with respect to the direction of the movement of the blades (10) with respect to the surface of the screen drum (2) that a foremost end of each groove (11) in the direction of movement is, along the axis of the drum in the discharge direction, at a greater distance from the other end of the screen drum than a rearmost end of the same groove (11) in the direction of movement.

2. A device according to claim 1, characterized in that at least some of the blades (10) are provided with grooves (11) substantially over their upward extent.

3. A device according to claim 1, characterized in that at least some of the grooves (11) in at least some of the blades (10) have a length not greater than one half of the width of one of the blades (10).

4. A device according to claim 3, characterized in that each blade has a side facing the screen drum and a surface of the blades (10) on the side facing the screen drum (2) is convex with a portion of the surface being positioned closer to the screen drum than the remaining portion of the surface and that the grooves (11) having a length smaller than the width of the blade (10) are formed in said portion of the surface of the blades (10)

which is positioned closest to the surface of the screen drum (2).

5. A device according to claim 1, characterized in that at least some of the grooves (11) in the blades (10) are triangular in cross-section.

6. A device according to claim 1, characterized in that the grooves (11) are formed substantially directly into the blade substantially in parallel with each other.

7. A device according to claim 1, characterized in that the screen drum (2) is mounted unrotatably and the blades (10) are mounted to a rotor (6) rotating coaxially with the screen drum (2), so that the blades rotate with the rotor around the screen drum (2).

8. A blade assembly (10) for a pulp screening device for removing a rejected pulp fraction from a desired pulp fraction comprising a screen drum (2) having a surface provided with openings and allowing the passage of the desired pulp fraction therethrough, and at least one substantially upwardly extending blade (10) positioned close to the surface of the screen drum (2), one of the screen drum (2) and the blade (10) being mounted rotatably for movement in a predetermined direction around the axis of the screen drum (2) so that the blade (10) and the surface of the screen drum (2) move with respect to each other through a rotatory motion, and the pulp being introduced into the screening device to one end of the screen drum (2) and the rejected pulp fraction traveling along the axis of the screen drum in a discharge direction to be discharged from the other end thereof, characterized in that in order to transfer the rejected pulp in the discharge direction, the blade is provided with grooves (11) transverse to the upward extent of the blade (10), said grooves being so inclined with respect to the direction of the movement of the blades (10) with respect to the surface of the screen drum (2) that a foremost end of each groove (11) in the direction of movement is along the axis of the drum in the discharge direction, (2) at a greater distance from the other end of the screen drum than a rearmost end of the same groove (11) in the direction of movement.

9. A blade assembly (10) according to claim 8, characterized in that at least some of the grooves (11) have a length not more than one half of the width of the blade (10).

10. A blade assembly (10) according to claim 9, characterized in that the blade has a side facing the screen drum and a surface of the blade (10) on the side facing the screen drum (2) is convex with a portion of the surface being positioned closer to the screen drum than the remaining portion of the surface and that the grooves (11) having a length smaller than the width of the blade (10) are formed in said portion of the surface of the blade (10) which is arranged to be positioned closest to the surface of the screen drum (2).

11. A blade assembly (10) according to claim 7, characterized in that the grooves (11) are positioned substantially over the upward extent of the blade (10).

12. A blade assembly (10) according to claim 7, characterized in that at least some of the grooves (11) are triangular in cross-section.

13. A blade assembly (10) according to claim 7, characterized in that the grooves (11) are formed substantially directly into the blade substantially in parallel with each other.

* * * * *